United States Patent [19]

Joshi

[11] Patent Number: 4,923,627

[45] Date of Patent: May 8, 1990

[54] HARD TRANSLUCENT HIGH MOISTURE SOAP BAR

[75] Inventor: David P. Joshi, South Plainfield, N.J.

[73] Assignee: Colgate-Palmolive Company, Piscataway, N.J.

[21] Appl. No.: 259,766

[22] Filed: Oct. 19, 1988

[51] Int. Cl.[5] ..... C11D 13/18

[52] U.S. Cl. ..... 252/108; 252/134; 252/368; 252/DIG. 16

[58] Field of Search ..... 252/108, 132, 134, 368, 252/370, DIG. 16

[56] References Cited

U.S. PATENT DOCUMENTS

| | | | |
|---|---|---|---|
| 2,005,160 | 6/1935 | Pape | 87/16 |
| 2,686,761 | 8/1954 | Ferguson et al. | 252/368 |
| 2,710,057 | 6/1955 | Bassett | 159/47.1 |
| 2,945,819 | 7/1960 | Mazzoni | 252/367 |
| 2,970,116 | 1/1961 | Kelly et al. | 252/368 |
| 3,793,214 | 2/1974 | O'Neill et al. | 252/117 |
| 3,864,272 | 2/1975 | Toma et al. | 252/125 |
| 3,926,828 | 12/1975 | O'Neill et al. | 252/117 |
| 4,490,280 | 12/1984 | Joshi et al. | 252/368 |
| 4,493,786 | 1/1985 | Joshi | 252/368 |
| 4,584,126 | 4/1986 | Joshi | 252/368 |
| 4,678,593 | 7/1987 | Ridley | 252/131 |

FOREIGN PATENT DOCUMENTS 1033421 6/1966 United Kingdom .

OTHER PUBLICATIONS

Berti, C. "The Mazzoni Soap Drying Process", Soap and Sanitary Chemicals, May 1947, pp. 38–40.

*Primary Examiner*—Prince E. Willis

*Attorney, Agent, or Firm*—Richard J. Ancel; Robert C. Sullivan; Murray M. Grill

[57] ABSTRACT

A process for making hard, translucent, high moisture soap bars at 18–27% moisture. These soap bars are produced by varying the conditions of vacuum drying such that the crystalline structure of the soap remains small thereby producing better translucency of the soap pellets. These soap pellets that when compounded through conventional soap finishing equipment produce hard, machinable, high moisture, translucent soap bars.

2 Claims, No Drawings

HARD TRANSLUCENT HIGH MOISTURE SOAP BAR

TECHNICAL FIELD

This invention relates to a method of producing hard, translucent, high moisture soap bars and product produced thereby.

BACKGROUND OF THE INVENTION

The usual difference between non-transparent soaps and transparent or translucent soap lies in the crystallization of the finished soap product. Non-transparent soaps will normally solidify from a hot fluid state to a crystal conglomerate, which contains more or less soap in a colloidal dispersed state. On the other hand, translucent soap is made by keeping the crystal size of the soap bar small or by inhibiting crystallization of the soap during solidification of these bars.

In the past, translucent soaps were prepared by incorporating clarifying agents such as lower alkanols (soap crystallization inhibitors) and the soaps were framed, not milled and plodded. Subsequently, it was discovered that milled and plodded translucent soaps could be made by a variety of methods including careful regulation of electrolyte content, utilizing resin soaps, employing potassium soap, controlling moisture content, and utilizing specialized soap formulas. Also, careful control of the working of particular formulas and energy added to them during the processing was found to be useful in some cases in making translucent soap tablets by a process which included plodding of the soap and pressing of lengths cut from an extruded plodder bar.

For example, in U.S. Pat. No. 2,005,160 a natural resin is used in the production of a translucent soap bar and the process required spreading the hot fluid kettle soap in a thin layer and cooling that layer to room temperature, ie. specifically, it is stated that the soap is chilled to about 20° C.

Although prior art shows that translucent and transparent soap bars could be made, the processes and the product were too often unsatisfactory. For example, crystallization inhibitors often made the soap malodorous or adversely affected the soap's tactile properties. The additives tended to evaporate in the process of making the translucent bar and therefore caused the product to lose its transparency. Some crystallization inhibitors caused the development of hard specks in the soaps, while others made the soap mushy or liable to slough excessively when it became wet, as when standing in a soap dish with water in contact with the cake bottom. When certain working conditions were required to produce a transparent soap via milling, plodding, and pressing, the processes employed would often take too long to be economical, or the process control would be too critical, so that excessive scrapping of off-specification product would result.

Today, it is generally accepted, that translucent soap can be made by keeping the crystal size of the finished soap bar small through either the use of new crystallization inhibitors or by use of high shear extrusion, that requires expensive and specialized equipment, to break down the crystal size. For example, in U.S. Pat. Nos. 3,793,214 and 3,864,272, glycerine and polyethylene glycol are added to the soap to promote translucency.

Other well known additives include lanolin, sorbitol, and ethanol, to mention only a few.

Although translucency is difficult to achieve in a soap bar without additives or use of specialized equipment, high moisture translucent soap bars are rarely produced, since high moisture content in soap bars tends to make these bars soft. High moisture soaps are commercially available today. However, these soaps are either opaque or in the form of laundry soaps, which are often soft, nonmachinable, and not very translucent.

It is therefore, an object of the present invention to provide a process for the manufacture of translucent, high moisture soap bars.

It is a further object of the present invention to produce high moisture, bars translucent soap bars, without special additives or by using specialized equipment.

It is a still further object of the present invention to produce a translucent, hard soap bar at a moisture content between 18–279.

SUMMARY OF THE INVENTION

A hard, translucent, high moisture soap bar is prepared without special additives or use of specialized equipment through the process of heating a wet kettle soap then spray drying the soap under vacuum, extruding the soap into pellets, plodding said pellets and pressing into bars.

The present invention comprises the following steps:

a. preparing a wet kettle soap at 29–32% moisture and in a molten state of 160–190° F.;

b. heating and spray drying said wet kettle soap at a temperature of 190–230° F. under vacuum;

c. extruding said soap containing 18–27% moisture to make pellets which are at 90–100° F.;

d. processing said pellets through a vacuum plodder; and e. pressing soap into bars at a temperature of 90–120° F.

DETAILED DESCRIPTION

The present invention concerns a process for manufacturing, hard, translucent, high moisture soap bars.

Any wet kettle soap may be utilized in the present invention, provided that the soap contains between 29–32% $H_2O$ content.

This invention relates to attempting to keep the crystal size of the soap small by varying the conditions of spray drying under vacuum such that translucent soap is formed without using chemical additives or specialized equipment. In order to accomplish this task, the molten kettle soap is first heated to a temperature of 190° F. but not more than 230° F. The soap is then dried by spraying in a vacuum flash chamber at a temperature between 190–225° F. The vacuum in the flash chamber is between about 20–30 inches of mercury, but preferably 30 inches of mercury. The resultant 18–27% $H_2O$ dry soap is then extruded via a double stage twin-screw extruder to make pellets which are at between 90–100° F.

These pellets may be then transferred, stored, and processed through a conventional refiner and vacuum plodder, or continuously plodded into bars. The bars are then pressed and are at a temperature of between 90–120° F. and have a Dietart Hardness of 90–92.

Analysis of the crystalline phase profile through differential scanning calorimetry shows high moisture-binding properties. X-ray differentiation methods indicate these soaps to be high in the Beta phase (up to 90%).

We claim:

1. A process for preparing hard translucent, high moisture soap bars without special additives comprising the steps of:

(a) reparing a molten wet kettle soap containing 29 to 32% water, (b) heating the molten wet kettle soap to a temperature of about 190° F., (c) spray drying the molten wet kettle soap in a spray dryer operated at a temperature of 190–230° F. under vacuum;

(d) extruding the spray dried soap containing 18–25 percent water to prepare pellets, (e) plodding the pellets in a vacuum plodder, (f) pressing the plodded soap at a temperature of 90 to 100° F. into bars, (g) recovering the hard translucent, high moisture soap bar product.

2. A process according to claim 1 wherein said vacuum flash chamber is at a vacuum of about between 20–30 inches of mercury.

* * * * *